US005175586A

United States Patent [19]

Goseki et al.

[11] Patent Number: 5,175,586

[45] Date of Patent: Dec. 29, 1992

[54] DEVELOPING APPARATUS AND DEVELOPER CARRYING MEMBER THEREFOR

[75] Inventors: Yasuhide Goseki, Yokohama; Shigemori Tanaka, Kawasaki; Akira Unno, Yokohama; Yusuke Yamada, Machida; Kenji Fujishima, Yono, all of Japan

[73] Assignee: Canon Kabushiki Kaisha, Tokyo, Japan

[21] Appl. No.: 827,386

[22] Filed: Jan. 29, 1992

[30] Foreign Application Priority Data

Jan. 31, 1991 [JP] Japan ..... 3-031838
Jan. 31, 1991 [JP] Japan ..... 3-031842

[51] Int. Cl.[5] ..... G03G 15/06

[52] U.S. Cl. ..... 355/259; 118/657; 118/658; 118/661; 355/251

[58] Field of Search ..... 118/657, 658, 661; 355/245, 251, 259; 29/132

[56] References Cited

U.S. PATENT DOCUMENTS 4,696,255 9/1987 Yano et al. ..... 118/653
4,989,044 1/1991 Nishimura et al. ..... 355/251

*Primary Examiner*—A. T. Grimley
*Assistant Examiner*—P. J. Stanzione
*Attorney, Agent, or Firm*—Fitzpatrick, Cella, Harper & Scinto

[57] ABSTRACT

A developing apparatus for developing an electrostatic latent image includes a movable developer carrying member for carrying a one component developer to a developing zone in which the developer is supplied to an electrostatic latent image bearing member; and a regulating member for regulating a thickness of a layer of the developer to be carried to the developing zone on the developer carrying member; wherein the developer carrying member comprises a coating layer comprising a resin material in which fine graphite particles are dispersed, and wherein an inclination of a work function measurement curve of a surface of the coating layer is not less than 10 (cps/eV).

14 Claims, 2 Drawing Sheets

DEVELOPING APPARATUS AND DEVELOPER CARRYING MEMBER THEREFOR

FIELD OF THE INVENTION AND RELATED ART

The present invention relates to a developing apparatus for developing an electrostatic latent image formed on an image bearing member and a developer carrying member for carrying the developer to a developing zone, used with the developing apparatus.

In a developing apparatus for developing an electrostatic latent image formed on an image bearing member in the form of an electrophotographic photosensitive drum, for example, with magnetic toner particles of one component developer, friction between a developer carrying member in the form of a developing sleeve and magnetic toner particles is used to electrically charge the magnetic toner particles to a polarity opposite from that of the electrostatic image charge on the photosensitive drum and that of the reference potential of the development. The magnetic toner particles are applied on the developing sleeve as a thin layer and are conveyed to a developing zone where the developing sleeve is faced to the photosensitive drum. In the developing zone, the magnetic toner particles are transferred onto the electrostatic latent image on the photosensitive drum surface, and are deposited thereon, thus visualizing the electrostatic latent image into a toner image. Such a developing apparatus is known.

If, in such a developing apparatus, the images having large white background area are continuously developed, and thereafter, a different pattern is developed, the image formed may have hysteresis of the previous image. This is called "ghost development". The reason for the occurrence of the ghost image is as follows.

If the white background continues, the toner on the sleeve is not consumed, and therefore, a layer of very fine toner particles overcharged are electrostatically attracted on the surface of the sleeve with strong force. The fine particle toner layer is not easily transferred onto the photosensitive drum, and also prevents the triboelectric charging between the sleeve and fresh toner particles supplied thereto. Accordingly, if the images having large white background areas are continuously formed, and thereafter, a black image is formed, the image density of the black image is low. This is the reason why the ghost development occurs.

A developing apparatus in which the occurrence of the ghost development is prevented, is proposed in U.S. Pat. No. 4,989,044, in which the sleeve is provided with an outer coating layer having fine graphite particles dispersed in a resin material. The fine graphite particles are effective to discharge the electric charge of the overcharged fine toner particles. In addition, it exhibits a high solid state lubrication and therefore, is effective to weaken the attraction of the fine toner particles to the sleeve. This prevents production of the above-described fine toner particle layer, thus suppressing occurrence of the ghost development. However, in such an apparatus, a problem other than the ghost development or phenomenon has arisen. More particularly, the developed image involves a low image density portion extending in a direction in which the development action proceeds. In the case of character images, the characters are thinned, and in the case of a halftone image or solid black image, the image density is low.

This is called in this Specification "fading". Observing the sleeve when the fading phenomenon occurs, the toner layer was formed in a uniform thickness on the sleeve. However, measurement of the triboelectric charge amount of the toner on the sleeve has revealed that the charge amount of the toner in the low density region in the image is lower than the normal level.

The reason for the occurrence of the local low charge amount portion is not clear, but it is considered that the fluidity of the toner is locally insufficient in the toner stagnating region in the developing container adjacent to the sleeve.

In any event, the low charge toner particles pass by the friction with the sleeve through a developer layer thickness regulating zone in the thickness equivalent to the normally charged toner particle layer. Therefore, the thickness of the toner layer is uniform on the sleeve.

The fading phenomena tends to occur under high temperature and high humidity conditions in which the triboelectric charge of the toner tends to be low.

SUMMARY OF THE INVENTION

Accordingly, it is a principal object of the present invention to provide a developing apparatus wherein the ghost phenomenon and the fading phenomenon can be effectively prevented.

It is another object of the present invention to provide a developing apparatus capable of forming developed images of high quality.

It is a further object of the present invention to provide a developer carrying member capable of effectively preventing the ghost phenomena and fading phenomena, and therefor capable of providing good developed images.

It is a yet further object of the present invention to provide a method of evaluating a developer carrying member.

According to an aspect of the present invention, there is provided a developing apparatus for developing an electrostatic latent image, comprising: a movable developer carrying member for carrying one component developer to a developing zone in which the developer is supplied to an electrostatic latent image bearing member; a regulating member and for regulating a thickness of a layer of the developer to be carried to the developing zone on the developer carrying member; wherein the developer carrying member comprises a coating layer including a resin material in which fine graphite particles are dispersed, and wherein an inclination of a work function measurement curve of a surface of the coating layer is not less than 10 counts per second per electron volt (cps/eV).

The inclusion of the fine graphite particles in the coating layer of the developer carrying member permits escape of the electric charge of the over charged fine toner particles. The solid state lubrication of the fine graphite particles mechanically eases the deposition force of the fine toner particles to the developer carrying member. In this manner, the occurrence of the ghost development or phenomena is suppressed.

Inclination ($\gamma$) of the work function measurement curve of the coating surface layer is not less than 10 (cps/eV). The inclination $\gamma$ corresponds to the quantum efficiency, and therefore, to the triboelectric charge application power to the developer. If the inclination $\gamma$ is not less than 10 (cps/eV), the developer can be provided with sufficient triboelectric charge.

On the other hand, the inclination $\gamma$ also corresponds to an exposure ratio of the graphite fine particles in the coating layer, and therefore, to the degree of the solid lubrication of the coating layer surface. If the inclination $\gamma$ is not less than 10 (cps/eV), the developer particles can fairly easily slide on the surface of the developer carrying member. Therefore, the developer having the low electric charge is unable to pass under the developer layer regulation member. Therefore, the developer properly charged through triboelectricity is electrostatically deposited on the developer carrying member by the mirror force, so that it can pass under the regulating member.

As a result, a uniform developer layer composed of properly triboelectrically charged developer particles is formed on the developer carrying member, and therefore, the fading can be prevented even under the high temperature and high humidity conditions.

Furthermore, the image density of the developed image can be stabilized even when a large number of images are continuously printed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
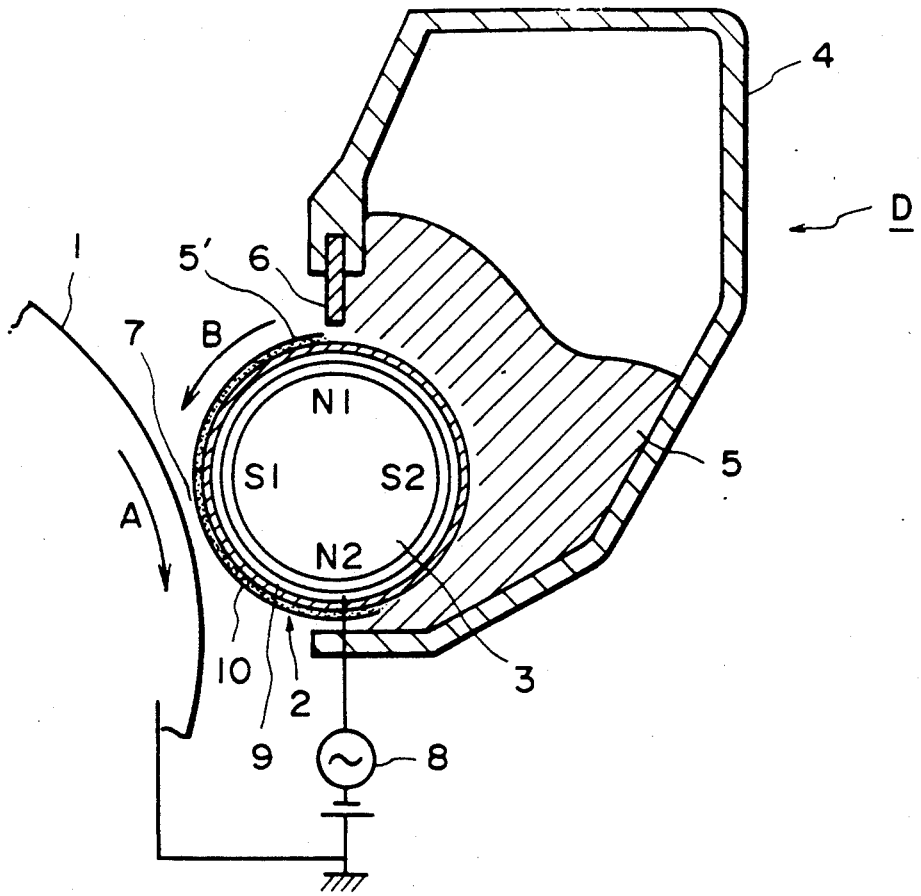
FIG. 1 is a sectional view of a developing apparatus according to an embodiment of the present invention.

Referring to FIG. 1, there is shown a developing apparatus according to an embodiment of the present invention, which comprises an image bearing member in the form of an electrophotographic photosensitive drum 1 rotatable in a direction indicated by an arrow A and is capable of bearing an electrostatic latent image. The photosensitive drum 1 may or may not have a surface insulative layer. The photosensitive drum 1 may be replaced with a photosensitive sheet or belt.

The photosensitive drum 1 is uniformly charged to a negative polarity by an unshown developing device, and is exposed to a laser beam modulated in accordance with image information signal, so that a negative electrostatic latent image is formed. In place of the laser beam, the image information beam may be projected to the surface of the photosensitive drum 1 by LED array or the like.

The electrostatic latent image is reverse-developed in the developing zone 7 by a developing apparatus D with a magnetic toner triboelectrically charged to the negative polarity.

The developing apparatus D comprises an image bearing member in the form of a developing sleeve 2 in an opening of a developer container 4 containing a one component developer, that is, magnetic toner 5. The developing sleeve 2 is faced to the photosensitive drum 1.

The developing sleeve 2 carries the toner 5 in the container 4 and rotates in the direction B. By doing so, the sleeve 2 carries the toner to the developing zone where the sleeve 2 is faced to the photosensitive drum 1. A plurality of magnetic poles of a permanent magnet 3 are stationarily disposed in the sleeve 2. At a position across the sleeve 2 from a magnet N1 of the magnetic poles, a developer layer thickness regulating member in the form of a doctor blade 6 made of magnetic material is disposed with a predetermined gap from the developing sleeve 2 to regulate the toner layer on the developing sleeve 2 into a predetermined thickness. The magnetic field extending from the magnetic pole N1 is concentrated on the blade 6. In this embodiment, the gap between the doctor blade 6 and the developing sleeve 2 is approximately 50–500 microns.

In operation, when the developing sleeve 2 rotates in the direction B, the toner 5 in the developer container 4 is electrically charged to a polarity for developing the electrostatic latent image by friction with the surface of the developing sleeve 2, and is carried on the developing sleeve 2 surface. The layer of the toner 5 thus applied on the developing sleeve 2 surface is regulated by the magnetic field between the magnetic pole N1 of the magnet 3 and the doctor blade 6 into a uniform and thin toner layer having a thickness of approximately 30–300 microns. With the developing sleeve 2 rotation, the toner 5 in the form of a thin layer 5' is carried into the developing zone 7, where the toner is supplied to the surface of the photosensitive drum 1 to develop the electrostatic latent image thereon. More particularly, the toner is deposited to the light potential region of the latent image. The thickness of the toner layer 5' is smaller than the minimum gap between the developing drum 1 and the developing sleeve 2 in the developing zone 7 (50–500 microns, for example), and the developing action is what is called non-contact type developing action.

The developing sleeve 2 is supplied with an oscillating bias voltage in the form of a DC biased AC voltage from the voltage source 8. By doing so, an oscillating electric field is formed in the developing zone 7. The oscillating electric field promotes removal of the toner from the sleeve 2 toward the drum 1, and therefore, a high density image without foggy background can be produced.

In this embodiment, the developing sleeve 2 is provided with a surface coating layer 10 of a resin material containing at least crystalline graphite as conductive fine particles, the layer having a thickness of approximately 0.5–30 microns. A base member of the developing sleeve 2 on which the coating layer 10 is applied is in the form of a cylinder 9 of aluminum or stainless steel or the like.

As for the fine conductive particles, fine crystalline graphite particles or a mixture of fine amorphous carbon particles and crystalline graphite fine particles, are usable. The crystalline graphite usable in this embodiment may be classified into natural graphite and artificial graphite. The artificial graphite may be produced by solidifying pitch cokes with tar, sintering it at approximately 1200° C., putting it in a graphitizing furnace to heat it at 2300° C. approximately to develop the carbon crystal into graphite. The natural graphite has been produced by long term ground heat and pressure application into a complete graphitization.

The carbon graphite is a dark gray or black glossy and very soft crystal of carbon showing high sliding property. The crystalline structure thereof is hexagonal or rhombohedral and is completely laminated. As for the electrical nature, there are free electrons in the combination between carbons, so that it is good electrical conductive material. In this embodiment, either of the natural or artificial graphite is usable. The preferable average particle size of the graphite is 0.5–20 microns.

As for the fine carbon particles, conductive amorphous carbon is usable. The conductive amorphous carbon is generally defined as aggregate of crystals produced by burning or pyrolytically decomposing a compound including hydrocarbon or carbon under a poor supply of air. The average particle size of the electrically conductive amorphous carbon used in this embodiment is preferably 10–80 mμ, and is most preferably 15–40 mμ.

The usable binder resins in which the fine conductive particles are dispersed include, for example, thermoplastic resins such as styrene resins, vinyl resins, polyether sulfone resins, polycarbonate resins, polyphenylene oxide resins, polyamide resins, fluorine resins, cellulose resins, acrylic resins or the like, and thermo-setting or photo-curing resins such as epoxy resins, polyester resins, alkyd resins, phenol resins, melamine resins, polyurethane resins, urea resins, silicone resins, polyimide resins, or the like. Among them, silicone resin, fluorine resin or the like having the parting property, and the polyether sulfone resin, polycarbonate resin, polyphenylene oxide resin, polyamide resin, phenol resin, polyester resin, polyurethane resin, styrene resin or the like having high mechanical strength, are desirable.

The one component developer (toner) usable with the present invention will be described.

As for the binder resins. known resins are usable. Examples of them include styrene resins and derivatives such as styrene, α-methylstyrene, p-chlorostyrene; monocarbonic acid and derivatives having a double bond, such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, methacrylonitrile, diethylaminoethyl methacrylate, diethylaminoethyl methacrylate, acryloamide; dicarbonic acid and derivatives having a double bond, such as maleic acid, butyl maleate, methyl maleate, dimethyl maleate; a polymer or copolymer of one or more vinyl monomers, such as a vinyl resin such as vinyl chloride, vinyl acetate, vinyl benzoate, vinylester resin, vinylether resin, such as vinyl ethyl ether, vinyl methyl ether, vinyl isobutyl ether or the like; styrene-butadiene copolymer, silicone resin, polyester resin, polyurethane resin, polyamide resin, epoxy resin, polyvinyl butyral resin, rosin, modified rosin, terpene resin, phenol resin, aliphatic or alicyclic hydrocarbon resin, aromatic petroleum resin, fluorinated paraffin or the like. They may be used individually or may be used in combination.

The toner may contain pigment, which includes carbon black, nigrosin dye, lamp black, Sudan black SM, fast yellow G, benzidin yellow, pigment yellow, Indofast orange, irgazine red, baranitroanyline red, toluizine resin, carmin FB, permanent bordeaux FRR, pigment orange R, lithol red 2 G, lake red C, rhodamine FB, rhodamine B lake, methyl violet B lake, phthalocyanine blue, pigment blue, brilliant green B, phthalocyanine green, oil yellow GG, zapon fast yellow CGG, Kayaset Y 963, Kayaset YG, Sumiplast Yellow GG, Zapon Fast Orange RR, Oil Scarlet, Sumiplast Orange G, Orazole Brown B, Zapon Fast Scarlet CG, Izenspiron Red BEH, Oil Pink OP or the like.

In order for the toner to be given the magnetic property, magnetic particles are contained in the toner. Examples of the magnetic particles include ferromagnetic metal powers such as an iron, cobalt, nickel or the like powder, and metal alloys or compounds such as magnetite, hematite, ferrite or the like. The content of the magnetic particles is 15–70% approximately by weight on the basis of toner weight.

The toner powder may contain various parting materials. The usable parting materials include polyethylene fluoride, fluorine resin, fluorine carbonized oil, silicone oil, low molecular weight polyethylene, low molecular weight polypropylene and the like. In order to promote the positive or negative charging of the toner, charge controlling agent may be added.

These materials including the toner binder resin materials, are mixed, kneaded and pulverized through various processes, and the particles having desirable particle sizes are used as the toner. To the thus obtained toner powder, colloidal silica or the like is added and stirred. Then, it is usable as the toner.

Since the sleeve 2 is coated with the resin layer 10 containing the fine graphite particles in the dispersed state, a part of the electric charge of the fine toner particles overcharged is escaped through the graphite particles. In addition, the lubricating nature of the graphite fine particles exposed to the surface of the layer 10 is effective to reduce the deposition force between the fine toner particles and the surface of the sleeve. Therefore, the production of a ghost can be prevented.

Where the fine amorphous carbon particles are dispersed in the layer 10, they contribute to permit a part of the electric charge of the fine particle toner overcharged to escape. As described in the foregoing, the fading phenomenon is attributable to the undesirable establishment of a low charge toner layer only in a part of the longitudinal region of the sleeve. The insufficiently charged toner particles as well as sufficiently charged toner particles pass through the concentrated magnetic field formed between the doctor blade 6 of the magnetic material and the magnet 3, by the friction applied by the surface of the developing sleeve, and they are contained in the toner layer on the sleeve. Therefore, the charge amount of the toner layer is locally low, and therefore, even if they are placed in an alternating electric field between the photosensitive drum and the developing sleeve, the low charge toner layer is not contributable to develop the electrostatic latent image on the photosensitive drum, with the result of a longitudinal stripe or stripes of a low density portion on the developed image ("longitudinal" here means the direction in which the developing action proceeds).

In order to prevent this, it is desirable that the low charge toner which is weakly attached to the sleeve through the electrostatic force is prevented from passing through the concentrated magnetic field (magnetic field curtain) between the blade 6 and the magnet 3, while permitting the normally charged toner having a proper electrostatic deposition force to the sleeve to pass through the concentrated magnetic field, and that the sleeve surface is capable of properly charging the toner triboelectrically.

In consideration of this, in this embodiment, the inclination $\gamma$ of the work function measurement curve of the surface of the layer 10, that is, the sleeve 2 surface, is made not less than 10 (cps/eV).

The inclination $\gamma$ corresponds to the exposure ratio of the fine graphite particles at the surface of the layer 10, that is, at the surface of the sleeve. Therefore, the inclination $\gamma$ corresponds to the triboelectric charge application power to the toner and also to the sliding property of the surface of the sleeve.

The work function defining the inclination $\gamma$ is defined as a minimum energy required for taking one electron out of a surface of a material to a position immediately outside the surface. The work function may be measured by a photoelectron measurement device, for example, AC-1 available from Riken Keiki Kabushiki Kaisha, Japan. The device AC-1 is characterized in that the work function of the surface of the developing sleeve 2 is easily determinated in the atmosphere. It has been confirmed by the inventors that the work functions measured by the device AC-1 are equivalent to the values determined by Kelvin method (contact potential method, IBM, J. RES. DEVELOP 22, 1978).

Figure 2:
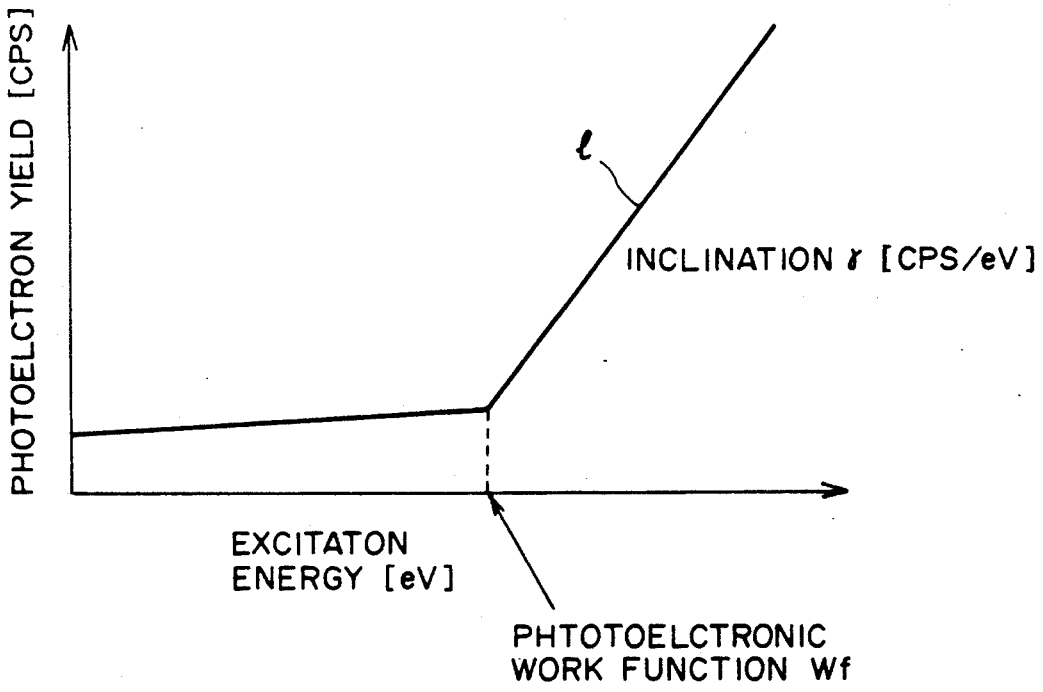
FIG. 2 is a graph of a work function measurement curve.

FIG. 2 shows the work function measurement curve obtained by the measurement using the device AC-1. In the graph of FIG. 2, the abscissa represents excitation energy (eV), and the ordinate represents the number of photoelectrons (yield) (cps, that is, the count per second). Generally, the number of emitted photoelectrons abruptly increases at a certain level, and therefore, the inclination steeply increases. This point is defined as the level of the work function Wf. The degree of photoelectron emission thereafter (light side of the Wf point) is defined by the inclination $\gamma$ of a rectilinear line 1 approximating the measured curve.

Examples of this embodiment will be described.

EXAMPLES 1-4

Developing sleeves 2 were manufactured in accordance with this embodiment, used for developing operation and image formation, and were evaluated.

The material of the toner used is as follows:

| | |
|---|---|
| Styrene-butylacrylate-n-butylhalfester-maleate copolymer | 100 wt. parts |
| Magnetite | 60 wt. parts |
| Negative charge controlling agent | 2 wt. parts |
| Low-molecular weight polypropylene | 2 wt. parts |

The materials are kneaded, pulverized and classified to produce a toner powder having a weight average particle size of 12.5 microns, containing 20% of 6.35 microns or less particles on the basis of number and 1.5% of 20.2 microns or larger toner particles on the basis of weight.

In order to evaluate the image forming operation, a commercially available laser beam printer LBP-SX (available from Canon Kabushiki Kaisha, Japan) was modified to attach to it an output device capable of providing plural kinds of image patterns. The process cartridge used was the commercially available process cartridge for the LBP-SX. The ends of the developing sleeve are formed into flanges to be mounted in the process cartridge commercially available. The test operations of image formation were carried out under 24° C. and 65% RH and under 30° C. and 80% RH.

The materials in the resin liquid for the coating were as follows:

| | |
|---|---|
| Phenol resin | 100 wt. parts |
| Graphite | 90 wt. parts |
| Carbon black | 10 wt. parts |
| Solvent | 200 wt. parts |

The solvent used was a mixture of IPA and butyl alcohol (1:1) which showed satisfactory compatibility. Four kinds of graphite particles, i.e., those having a particle size of not more than 1 microns, those having a particle size of 5 microns, those having a particle size of 10 microns and those having a particle size of 20 microns, were prepared. A sand mill was used to disperse and mix them to produce the coating resin liquid. The liquid was applied on an aluminum cylinder already having flanges at the longitudinal opposite ends, through a dipping method. It was dried to provide a resin coating layer 10 having a thickness of 20 microns on the developing sleeve 2. This was used for the developing operation.

TABLE 1

| | Ave. particle size of graphite (μm) | $\gamma$ (cps/eV) | Fading |
|---|---|---|---|
| Example 1 | ≦1 | 5 | N(G) |
| Example 2 | 5 | 10 | G(F) |
| Example 3 | 10 | 25 | G(G) |
| Example 4 | 20 | 40 | E(E) |

In Table 1, the evaluations on the fading outside the parentheses are for the condition of 24° C. and 60% RH, and the evaluations in the parentheses are for the condition of 30° C. and 80% RH. In the evaluations, E means Excellent; G means Good; F means Fair But Practically Usable; and N means Not Good.

As will be understood from Table 1, with the increase of the inclination $\gamma$ of the work function measurement curve of the developing sleeve 2 surface having the resin coating layer 10, the fading preventing effect increases, and good results are provided when the inclination $\gamma$ is equal to or larger than 10 (cps/eV).

EXAMPLES 5-9

The particle size of the graphite was fixed at 5 microns, the contents of the graphite or the like were changed, while the other conditions were the same as in the Examples 1-5. The resin coating layers 10 were produced on the developing sleeves 2, which were evaluated on the basis of image formation. The results are shown in Table 2.

TABLE 2

| | Phenol resin (wt. %) | Graphite (wt. %) | Carbon (wt. %) | Solvent (wt. %) | $\gamma$ (cps/eV) | Fading |
|---|---|---|---|---|---|---|
| Ex. 5 | 100 | 27 | 3 | 260 | 7 | N(N) |
| Ex. 6 | 100 | 45 | 5 | 300 | 8 | F(N) |
| Ex. 7 | 100 | 90 | 10 | 400 | 10 | G(G) |
| Ex. 8 | 100 | 180 | 20 | 600 | 25 | G(G) |
| Ex. 9 | 100 | 270 | 30 | 800 | 35 | E(E) |

As will be understood from Table 2, even if the contents of the graphite or the like are changed, the fading preventing effect becomes better with an increase of the inclination $\gamma$ of the work function measurement curve of the developing sleeve 2 surface having the resin coating layer 10. Good results are obtained where the inclination $\gamma$ is equal to or more than 10 (cps/eV).

EXAMPLES 10–14

In place of the solvent IPA/butylalcohol having a good compatibility, a solvent of MEK/toluene (1:1) not having a good compatibility was used, while the other conditions were the same as in Examples 1–4. Developing sleeves 2 having resin coating layers 10 were produced and were used for image formation, and the evaluations were made on the basis of the formed image. The results are shown in Table 3.

| | |
|---|---|
| Phenol resin | 100 wt. parts |
| Graphite | 90 wt. parts |
| Carbon black | 10 wt. parts |
| Solvent (MEK/toluene) | 200 wt. parts |

TABLE 3

| | Ave. particle size of graphite (μm) | γ (cps/eV) | Fading |
|---|---|---|---|
| Example 10 | ≦1 | 10 | G(F) |
| Example 11 | 5 | 25 | G(G) |
| Example 12 | 7 | 35 | E(E) |
| Example 13 | 10 | 38 | E(E) |
| Example 14 | 20 | 40 | E(E) |

As will be understood from Table 3, the inclination γ of the work function measurement curve of the surface of the developing sleeve having the resin coating layer 10 corresponds to the fading preventing effect.

Table 4 is an extract from the results of Examples 1 and 10. It will be understood from this Table that even if the same graphite is used in the same content relative to the resin, the change of the solvent for the coating layer 10 can increase the inclination γ of the work function measurement curve of the developing sleeve 2 surface, and therefore, can increase the fading preventing effect.

TABLE 4

| | Ave. particle size of graphite (μm) | γ (cps/eV) | Fading |
|---|---|---|---|
| Example 1 | ≦1 | 5 | N(N) |
| Example 10 | ≦1 | 10 | G(F) |

As described hereinbefore, the inclination γ corresponds to the degree of exposure of the fine graphite particles at the surface of the layer 10.

In view of this, in order to control the degree of exposure of the fine graphite particles in the manufacturing process of the sleeve, the surface of the layer 10 may be polished after the layer 10 is applied and dried on the sleeve base 9. This will be described in detail.

For manufacturing the developing sleeve 2, a drawing process is used to provide a blank sleeve 9 (surface roughness of 2S). The blank sleeve is coated by spraying with a coating resin liquid to a thickness of approximately 0.5–30 microns, the liquid having the following contents, and the liquid being dried in a drying furnace at 150° C. to cure the liquid resin by heat into the resin coating layer 10:

EXAMPLE 1 OF RESIN LIQUID

Binder resin: phenol resin: 30 parts by weight
Conductive lubricant: natural graphite (Nippon Kokuen, Japan): 27 parts by weight
Carbon black: conductex (Columbia Carbon): 3 parts by weight
Diluent: methylalcohol+methylcellosolve: 200 parts by weight.

EXAMPLE 2 OF RESIN LIQUID

Binder resin: phenol resin: 15 parts by weight
Conductive lubricant: artificial graphite (particle size of 10 microns): 15 parts by weight
Diluent: methylalcohol+methylcellosolve: 225 parts by weight.

By providing the coating layer 10 simply in this manner, it is difficult to provide a layer having a high degree of graphite exposure. It is effective to polish finally the surface of the developing sleeve 2. For example, by polishing the surface of the layer 10 by felt, the proper polishing process is possible.

The description will be made as to the polishing process of the developing sleeve 2 having the coating layer 10. The abrasive material used for the polishing is HW felt available from Hayashi Felt Kabushiki Kaisha, Japan which is 100% wool having a standard density of 0.34 g/cm$^2$. It has a width of 40 mm, a length of 200 mm and a thickness of 3 mm.

Figure 3:
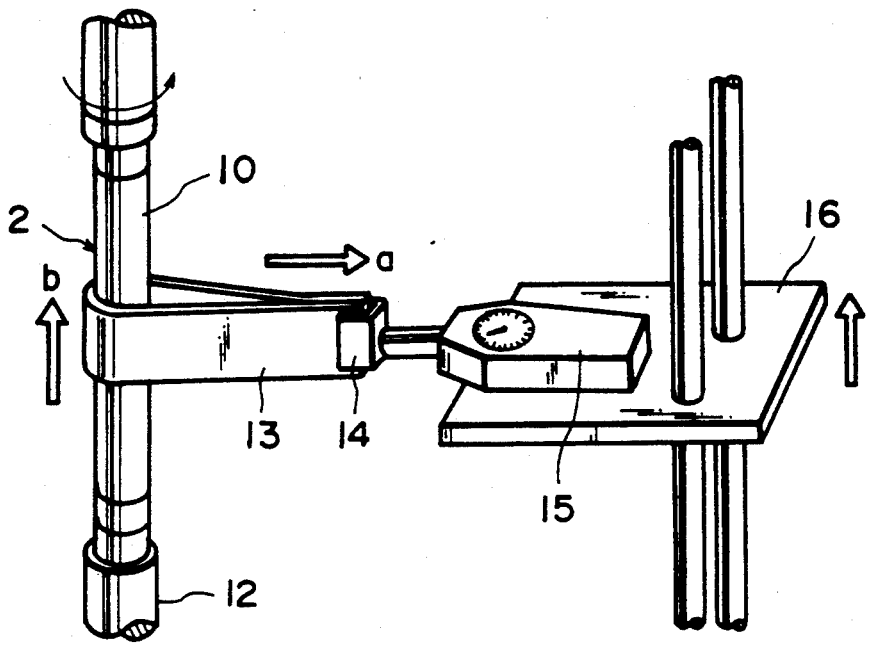
FIG. 3 is a perspective view of a polishing apparatus for polishing a surface of the developing sleeve.

FIG. 3 shows a surface polishing apparatus capable of easily exposing the crystalline graphite contained in the coating layer 10 of the developing sleeve 2. As shown in this Figure, the developing sleeve 2 is placed vertically, and is fixed by a main shaft 12 at the top and bottom ends, and is rotated by the main shaft 12 which is driven by an unshown driving device. Around the developing sleeve 2, an abrasive felt 13 in the form of a strand fixed on the holder 14 is extended, and is pulled in the direction a. The tension road at this time is measured by a load detector 15 directly connected to the holder 14. The load holder 15 is mounted on a carriage 16 movable together with the felt 13 in the longitudinal direction of the developing sleeve 2.

The developing sleeve fixed to the shaft 12 at the longitudinal ends thereof is rotated at a predetermined speed. At the initial stage, the felt is prevented from contacting the surface having the resin coating layer 10, and therefore, the felt 13 is placed at the top or bottom end of the developing sleeve 2. The felt 13 is pulled with a predetermined load using the load detector 15 through the holder 14 fixed to the felt 13, and the carriage 16 is moved up or down relative to the developing sleeve 2 at a predetermined speed. By doing so, the surface of the developing sleeve 2 is polished by the felt 13 press-contacted thereto, by which the crystalline graphite contained in the coating layer 10 is exposed.

Figures 4A, 4B:
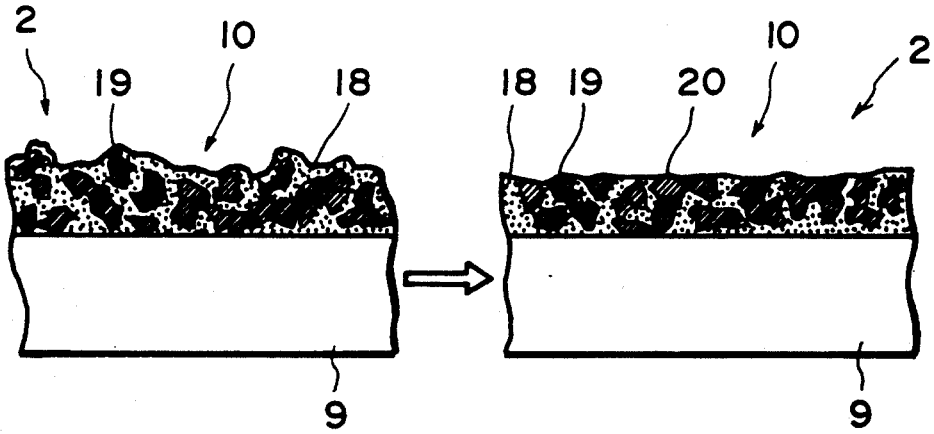
FIG. 4A is a sectional view of a coating layer of the sleeve before the polishing treatment.
FIG. 4B is a sectional view of a sleeve coating layer after the polishing treatment.

FIG. 4A is a sectional view of a developing sleeve 2 surface before the polishing process, and FIG. 4B shows the same after the polishing process. When the felt 13 is press-contacted to the resin coating layer 10 surface comprising the binder resin 18 and the crystalline graphite 19 shown in FIG. 4A, the surface portion of the coating layer 10 is collapsed by the pressure, and shearing force is applied with the result of shear fracture thereof. Then, as shown in FIG. 4B, the crystalline of the graphite 19 coated a thin film of the binder resin 18 in the coating layer 10 is exposed, and therefore, the surface of the crystals 20 appear. By controlling the pressure by the felt 13, the degree of the graphite 19 exposure can be controlled. By selecting the width of the felt 13, the degree of exposure of the graphite 19 can be controlled. The binder resin 18 or the crystalline graphite 19 (and also the conductive amorphous carbon or the like if any) in the coating layer 10 are gradually absorbed by the felt when they are removed from the coating layer 10, because the surface of the felt 13 is soft. The removed materials do not remain on the surface of the developing sleeve 2, and therefore, the surface of the developing sleeve 2 is polished while being cleaned.

As described in the foregoing, by polishing the surface of the layer 10, the inclination $\gamma$ of the work function measurement curve increases, thus enhancing the fading preventing effect. It has been found that the surface polishing process is also effective from the standpoint of stabilization of the image density, the operational stability against ambient condition change and the preventing of non-uniformity in the circumferential direction of the coating layer.

In order to improve the durability of the developing sleeve 2, such as the strength of the coating layer 10 itself, and the anti-peeling property of the coating layer 10, or from the standpoint of the uniformity of the coating layer 10, and/or in order to expose more graphite at the surface of the developing sleeve 2 while not permitting easy removal of the crystalline graphite fixed by the resin, it has been found that the surface thereof should be polished after the coating layer 10 is dried and solidified.

EXAMPLES 15-20

The materials of the toner used in the examples are as follows:

| | |
|---|---|
| Styrene-butylacrylate-acrylic acid copolymer | 100 wt. parts |
| Magnetite | 65 wt. parts |
| Negative charge controlling agent | 2 wt. parts |
| Low-molecular weight polypropylene | 2 wt. parts |

The materials are mixed, kneaded, pulverized and classified into a toner powder having a weight average particle size of 11.8 microns, and containing 26% of 6.35 microns or less particles on the basis of the number and containing 1.2% of 20.2 microns or larger particles on the basis of weight (measured by Coulter Counter TA-II). To the toner powder, colloidal silica of 0.4% was added. This was used as the toner.

In order to make an evaluation on the basis of image formation, a commercially available laser beam printer LBP-SX (available from Canon Kabushiki Kaisha, Japan) was modified by attaching an output device capable of providing plural kinds of image patterns. The process cartridge used with this laser beam printer was a commercially available process cartridge for the printer LBP-SX. In order to permit the developing sleeves to be mounted in the process cartridge, the longitudinal ends of the blank developing sleeve were formed into flanges. The image formation test operations were carried out under the condition of 23° C. and 65% RH.

The developing sleeve was produced in the following manner. First, the materials of the coating layer resin liquid were as follows:

Phenol resin: 30 parts by weight

Crystalline graphite (average particle size of 9 microns): 36 parts by weight

Carbon black: 4 parts by weight.

As a solvent, use was made of a mixture of IPA/-butylalcohol (220 parts by weight) milled by a sand mill to provide a coating resin liquid. It was applied on an aluminum cylinder (having flanges at the opposite ends), and the liquid was cured under the temperature of 150° C. into a resin coating layer having a thickness of 8 microns.

Then, the polishing apparatus shown in FIG. 3 was used, in which the pulling force of the abrasive material was controlled to control the degree of polishing. Thus, a developing sleeve sample shown in Table 1 was produced. The developing sleeve was incorporated in the LBP-SX cartridge. Then, the image formation test operations were carried out. The results are shown in Table 5.

TABLE 5

| | Polishing press (kg/cm$^2$) | $\gamma$ (cps/eV) | Image density | Fading |
|---|---|---|---|---|
| Example 15 | 4.5 | 48 | 1.2-1.4 | G |
| Example 16 | 3.5 | 38 | 1.2-1.4 | E |
| Example 17 | 2.5 | 30 | 1.2-1.4 | E |
| Example 18 | 1.5 | 24 | 1.2-1.3 | G |
| Example 19 | 0.5 | 10 | 1.1-1.3 | G |
| Example 20 | No polish | 5 | 0.8-1.4 | N |

In Table 5, the image densities are for those during the continuous production of a large number of prints, and were the data including variations obtained by a Macbeth reflection type density meter. The evaluations of the fading are such that E means excellent, G means good, N means not good.

In the Example 20 not using the polishing process, the inclination $\gamma$ of the work function measuring curve of the developing sleeve surface is as small as 5, and therefore, the fading preventing effect is poor. The Examples 15-19 using the polishing process, provides the inclination $\gamma$ which is not less than 10, and therefore, the fading preventing effect is satisfactory.

EXAMPLES 21-28

The ratio of the graphite content and the carbon content relative to the binder resin were changed, while the other conditions were the same in Examples 15-20. The developing sleeves were produced, and the same test operations were carried out. The thickness of the coating layer was 10 microns. The results are shown in Table 6.

TABLE 6

| | Phenol resin (wt. %) | Graphite (wt. %) | Carbon (wt. %) | Polishing press (kg · cm$^2$) | $\gamma$ (cps/eV) | Image density | Fading |
|---|---|---|---|---|---|---|---|
| Ex. 21 | 30 | 9 | 1 | 3 | 25 | 1.1-1.3 | G |
| Ex. 22 | 30 | 9 | 1 | No polish | 5 | 0.6-1.2 | N |
| Ex. 23 | 30 | 18 | 2 | 3 | 32 | 1.2-1.4 | E |
| Ex. 24 | 30 | 18 | 2 | No polish | 7 | 0.8-1.3 | N |
| Ex. 25 | 30 | 27 | 3 | 3 | 38 | 1.2-1.4 | E |
| Ex. 26 | 30 | 27 | 3 | No polish | 9 | 0.7-1.3 | N |
| Ex. 27 | 30 | 40 | 5 | 3 | 42 | 1.1-1.4 | E |
| Ex. 28 | 30 | 40 | 5 | No polish | 10 | 0.7-1.2 | G |

As will be understood, the polishing process for the layer 10 increases the inclination $\gamma$, so that the fading preventing power is improved, and in addition, the stability of the image density during continuous printing can be improved.

In the foregoing embodiments, a magnetic toner has been used as the one component developer. However, the present invention is not limited to such a toner, and is applicable to the case of a one component developer comprising non-magnetic toner.

The present invention is applicable to a developing apparatus of a regular development type wherein the toner is deposited on the dark potential area of the electrostatic latent image.

The developing bias voltage may be a DC voltage rather than the AC voltage.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing electrostatic latent image, comprising:

a movable developer carrying member for carrying a one component developer to a developing zone in which the developer is supplied to an electrostatic latent image bearing member; and a regulating member for regulating a thickness of a layer of the developer to be carried to the developing zone on said developer carrying member;

wherein said developer carrying member comprises a coating layer comprising a resin material in which fine graphite particles are dispersed, and wherein an inclination of a work function measurement curve of a surface of the coating layer is not less than 10 counts per second per electron volt.

2. An apparatus according to claim 1, wherein the coating layer has a polished surface.

3. An apparatus according to claim 1 or 2, wherein said coating layer contains fine amorphous carbon particles dispersed therein.

4. An apparatus according to claim 1 or 2, wherein said developer carrying member triboelectrically charges the developer for development of the electrostatic latent image.

5. An apparatus according to claim 4, wherein said regulating member is faced to said developer carrying member with a gap therebetween.

6. An apparatus according to claim 5, further comprising:

a stationary magnet in said developer carrying member, wherein the one component developer is magnetic, and said regulating member is disposed across said developer carrying member from a magnetic pole of the magnet to form a magnetic field between the magnetic pole and said regulating member.

7. An apparatus according to claim 6, further comprising a voltage source for applying an oscillating bias voltage to said developer carrying member.

8. An apparatus according to claim 7, wherein the thickness of the developer layer regulated by said regulating member is smaller than a minimum gap between said developer carrying member and the latent image bearing member, in the developing zone.

9. An apparatus according to claim 4, further comprising a voltage source for applying an oscillating bias voltage to said developer carrying member.

10. An apparatus according to claim 9, wherein the thickness of the developer layer regulated by said regulating member is smaller than a minimum gap between said developer carrying member and the latent image bearing member, in the developing zone.

11. A developer carrying member for carrying a one component developer to a developing zone for supplying the developer to an electrostatic latent image, comprising:

a base member; and an outer coating layer on said base member, comprising a resin material and fine graphite particles dispersed therein, wherein an inclination of a work function measurement cure of a surface of said coating layer is not less than 10 counts per second per electron volt.

12. A member according to claim 11, wherein said coating layer has a polished surface.

13. A member according to claim 11 or 12, wherein said coating layer comprises fine amorphous carbon particles dispersed therein.

14. A member according to claim 11 or 12, wherein said member triboelectrically charges the developer to a component for developing the electrostatic latent image.

* * * * *

UNITED STATES PATENT AND TRADEMARK OFFICE

CERTIFICATE OF CORRECTION

PATENT NO. : 5,175,586

DATED : December 29, 1992

INVENTOR(S) : GOSEKI, ET AL.

It is certified that error appears in the above-identified patent and that said Letters Patent is hereby corrected as shown below:

COLUMN 2

Line 44, "ber; a" should read --ber; and a--; and "and for" should read --for--.

COLUMN 10

Line 32, "a." should read --"a".--.
Line 59, "coated a" should read --coated with a--.

Signed and Sealed this

Twenty-third Day of November, 1993

Bruce Lehman

*Attest:*

BRUCE LEHMAN

*Attesting Officer*

*Commissioner of Patents and Trademarks*